United States Patent [19]

Davies

[11] 4,354,587

[45] Oct. 19, 1982

[54] COIN ACCEPTOR OR REJECTOR

[75] Inventor: Ronald C. Davies, Las Vegas, Nev.

[73] Assignee: Third Wave Electronics Company, Inc., Las Vegas, Nev.

[21] Appl. No.: 198,283

[22] Filed: Oct. 17, 1980

[51] Int. Cl.[3] ..... G07F 3/02

[52] U.S. Cl. ..... 194/100 A; 324/71 R; 324/236

[58] Field of Search ..... 194/97 R, 97 A, 97 B, 194/99, 100 R, 100 A, DIG. 1; 324/71 R, 77 D, 236

[56] References Cited

U.S. PATENT DOCUMENTS

| | | | |
|---|---|---|---|
| 2,642,974 | 6/1953 | Ogle | 194/100 R |
| 3,317,016 | 5/1967 | Turillon | 194/100 R |
| 3,453,532 | 7/1969 | Gardiner | 324/236 X |
| 3,587,809 | 6/1971 | Meloni | 194/100 A |
| 3,901,368 | 8/1975 | Klinger | 194/100 A |
| 3,956,692 | 5/1976 | Weinburg | 194/100 R X |
| 4,105,105 | 8/1978 | Braum | 194/100 A |
| 4,108,296 | 8/1978 | Hayashi | 194/100 A |
| 4,151,904 | 5/1979 | Levasseur | 194/100 A |
| 4,226,323 | 10/1980 | Dautremout | 194/100 A |
| 4,254,857 | 3/1981 | Levasseur | 194/100 A |
| 4,257,512 | 3/1981 | Hooker | 194/100 A |
| 4,275,806 | 6/1981 | Tanaka et al. | 194/100 A |

FOREIGN PATENT DOCUMENTS

| | | | |
|---|---|---|---|
| 951403 | 7/1974 | Canada . | |
| 1381278 | 1/1975 | United Kingdom | 194/100 A |

*Primary Examiner*—Allen N. Knowles
*Attorney, Agent, or Firm*—Jacobs & Jacobs

[57] ABSTRACT

The present invention provides a single coin acceptor or rejector for use with coin-operated machines, which has an oscillator circuit and a sensing coil, wherein the oscillator oscillates at a constant amplitude, and has sufficient gain that it will continue to oscillate at such constant amplitude when a coin is placed within the sensing coil. A field effect transistor (F.E.T.) which is utilized in the circuit becomes in effect a variable resistor, the value of which is controllable by materials passing through the sensing coil. Such effective resistance changes are detected by a resistor connected in series with the F.E.T. and which functions as a current to voltage converter. By two pairs of comparators and associated circuitry an opto isolator is activated if the output of one comparator of the second pair goes high while the output of the other comparator of the same pair remains low; and when activated the opto isolator triggers a triac which, in turn, activates the accept armature of an accept solenoid. Non-genuine coins do not activate the opto isolator and, in turn, the triac, and such coins are rejected. The coin acceptor or rejector apparatus has a flapper with a flange at its lower end disposed in a slot in the coin chute, said flapper being movable by a solenoid out of said slot to accept genuine coins, and when in the slot to direct non-genuine coins to rejection.

17 Claims, 6 Drawing Figures

COIN ACCEPTOR OR REJECTOR

The present invention relates to an apparatus for accepting or rejecting a single type of coin, which is designed and constructed only to accept genuine coins of a particular value or denomination, and to reject spurious coins or slugs which may have the same dimensions.

More particularly the present invention provides an auxiliary coin acceptor-rejector component or device which may readily be fitted into already existing coin operated devices so as to discriminate more accurately between genuine coins and spurious coins or slugs.

BACKGROUND OF THE INVENTION

There are today many devices on the market which are primarily intended to discriminate between genuine coins and spurious coins or slugs. In view of the large number of coin-operated machines in use, it has become increasingly important to discriminate between genuine and non-genuine coins so as to minimize the losses which operators of coin-operated machines incur each year. These losses multiply rapidly as the ingenuity of man is devoted to defeating the machine instead of accommodating to it. Thus it has become a continuing contest between coin-machine operators and coin-machine users to arrive at a coin discriminating apparatus which keeps to a minimum the acceptance of spurious coins or slugs.

With many coin discriminators, which depend upon oscillators and a resonating circuit influenced by the metal of the coin to be accepted or rejected, there are various local factors which affect the criticality of the acceptance/rejection circuitry, i.e., humidity, local temperature, and environmental changes such as the proximity of metallic objects.

SUMMARY OF THE INVENTION

The present invention provides a single coin acceptor or rejector for use with coin-operated machines, which has an oscillator circuit and a sensing coil, wherein the oscillator oscillates at a constant amplitude, and has sufficient gain that it will continue to oscillate at such constant amplitude when a coin is placed within the sensing coil. The presence of a coin within the sensing coil gives rise to: (a) a substantial decrease in the Q of the sensing coil; (b) energy losses caused by eddy currents being dissipated by the coin, and energy losses required to overcome the magnetic hysteresis of the coin; and (c) a rise in frequency of the oscillator because the coin acts as a shorted turn of the coil and effectively reduces its inductance.

Also, most prior art devices for discriminating as between genuine and spurious coins rely solely upon the instantaneous oscillator amplitude or frequency changes. To this end prior art oscillators have been designed to have a very high Q factor close to the critical criteria for oscillation. This particular design renders detection vulnerable to environmental conditions. It also has a very serious drawback from the standpoint of mass production of the component tolerances from unit to unit.

Also, in prior art devices rectification of the oscillator wave form is required which includes additional components and the problems inherent to the same. Finally, many prior art devices require separate coin scavenging devices which also create jamming problems in the chute acceptor and rejector areas.

While the cumulative effect of these loss factors normally would be expected to reduce the amplitude of oscillation, it is a feature of the present invention that the oscillator is designed with enough extra gain to overcome these losses by drawing more current from the supply and thereby to maintain the same amplitude of oscillation.

Also, a field effect transistor (F.E.T) which is utilized in the circuit becomes in effect a variable resistor, the value of which is controllable by materials passing through the sensing coil. Such effective resistance changes are detected by a resistor connected in series with the F.E.T. and which functions as a current to voltage converter.

By two pairs of comparators and associated circuitry an opto isolator is activated if the output of one comparator of the second pair goes high while the output of the other comparator of the same pair remains low; and when activated the opto isolator triggers a triac which, in turn, activates the accept armature of an accept solenoid.

Non-genuine coins do not activate the opto isolator and, in turn, the triac, and such coins are rejected.

PRIOR ART

According to applicant's best knowledge the closest prior art to the present invention is his own Canadian Pat. No. 951,403, dated July 16, 1974. Applicant is also aware of the following U.S. patents which generally relate to Coin Apparatus for Vending Machines: Ogle U.S. Pat. No. 2,642,974; Meloni U.S. Pat. No. 3,587,809; Klinger U.S. Pat. No. 3,901,368; Braum U.S. Pat. No. 4,105,105; Hayashi et al. U.S. Pat. No. 4,108,296; and British patent to F.A.T.M.E. No. 1,254,269.

Applicant is also the inventor in U.S. patent application Ser. No. 21,305, filed Mar. 15, 1979, wherein the following references were made of record in addition to his own Canadian Pat. No. 951,403: Turillon U.S. Pat. No. 3,317,016; Gardiner U.S. Pat. No. 3,453,532; Weinberg U.S. Pat. No. 3,956,692; and Levasseur et al. U.S. Pat. No. 4,151,904; and a publication entitled "Electrical Fundamentals for Technicians", 2nd Edition, by Robert L. Schrader (pp. 405 to 413).

In applicant's opinion none of the foregoing prior patents, publication and pending application discloses a coin acceptor and rejector as disclosed and claimed in the present application in that they do not include the inventive features summarized above and as hereinafter more fully disclosed and claimed.

DETAILED DESCRIPTION OF THE INVENTION

For a better understanding of the invention reference will now be made to the accompanying drawings, wherein:

FIGS. 5 and 6 should be read together as showing the full circuit diagram.

Figure 1:
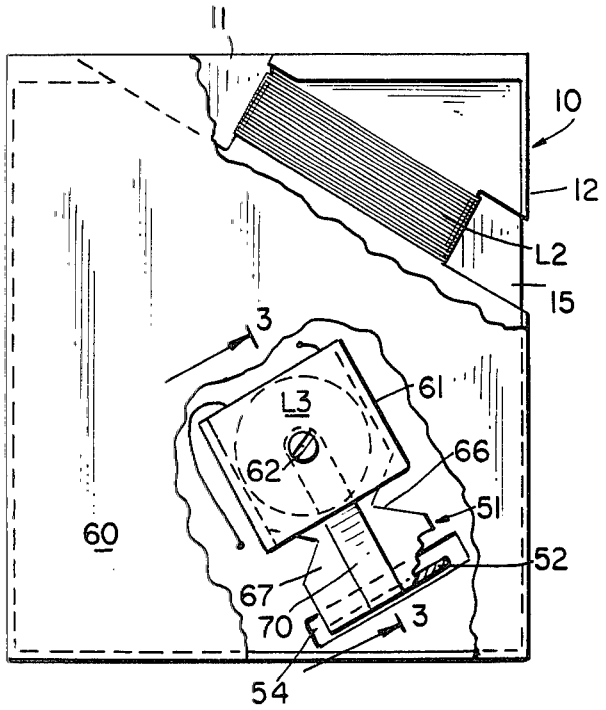
FIG. 1 is a front elevational view of the coin acceptor or rejector unit provided by the present invention which is shown in approximately full size, with certain parts being broken away to show underlying structure.
Figure 3:
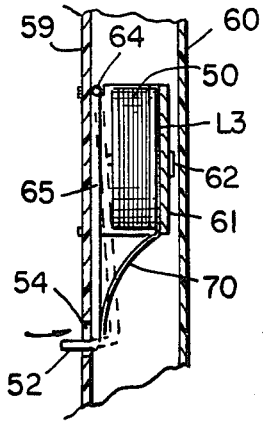
FIG. 3 is a sectional view taken along the line 3—3 of FIG. 1 and looking in the direction of the arrows.
Figure 2:
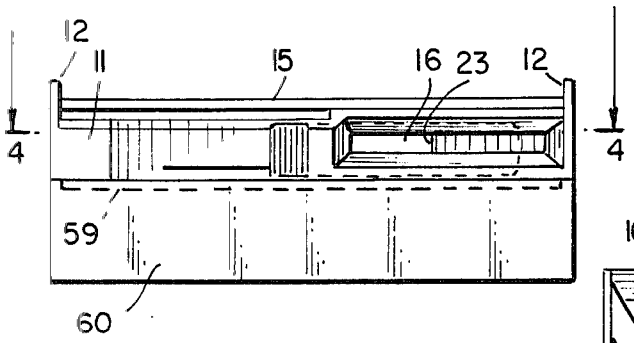
FIG. 2 is a top plan view of the unit shown in FIG. 1 and also being shown in approximately full size.
Figure 4:
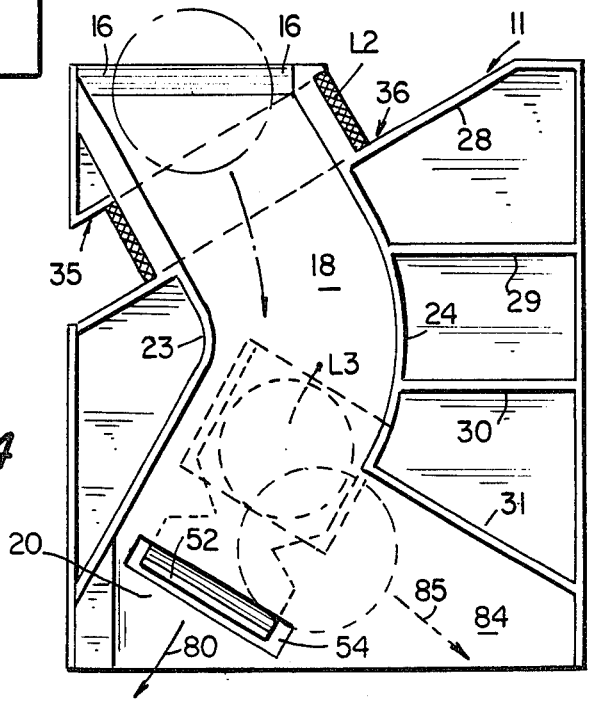
FIG. 4 is a vertical section taken along the line 4—4 of FIG. 2 looking in the direction of the arrows, and showing in full lines the coin acceptance and rejection chutes.

With reference first to FIGS. 1 to 4, inclusive, the coin acceptor or rejector unit 10 of the present invention has an intermediate member 11 having longitudinally-flanged sides 12 which are adapted to receive between them a back member or plate 15. The back plate 15 and the intermediate member 11, preferably made of a molded plastic material, at their upper ends together provide a coin receiving slot 16. The slot 16, in turn, connects with a coin chute 18, as best seen in FIG. 4, which is of arcuate form so as to direct the coin to an acceptance slot 20, if such coin is shown to be genuine by the unit of the present invention. The intermediate member 11, as best seen in FIG. 4, in addition to having the chute provided by upstanding molded flanges 23, 24 of arcuate form, also has upstanding reinforcing molded ribs 28, 29, 30 and 31.

Both the intermediate member 11 and the back plate 15 adjacent the coin receiving slot 16, have matching cutouts 35, 36 around which a tank coil L2 is wound so that a coin inserted in slot 16 will pass through such coil. Coil L2 is a sensing coil as more particularly hereinafter described.

At the lower end of the chute 18 there is provided an accept solenoid L3 which consists essentially of a coil 50, a metallic flapper 51 having inturned flange 52 which projects through mating slot 54 in the intermediate member 11 and the back plate 15 at the base of the chute 18 to block the same and to prevent the passage of a coin for acceptance by the machine to which the unit is applied, if such coin is determined by the unit to be non-genuine.

In addition to the intermediate molded plastic member 11 and backing plate 15 the unit also has an outer plate 59 which contains on its face all of the solid state components shown in the circuit diagram, which are suitably wired on the back of such plate in accordance with such circuitry. The entire circuit components on the front of such plate 59 are enclosed by a cover 60.

There is mounted on such plate 59 an inverted U-shaped member 61 to which accept solenoid L3 is attached at its top by a suitable screw 62. The metallic flapper 51 is hingedly connected to such plate 59 as at 64 and has a flat body member 65 generally of the size and shape to conform to the size and shape of the solenoid coil 50. It also has a narrowed neck 66 which connects with the outer flanged portion 67 of the flapper. A leaf spring 70 is secured to the inner face of the inverted U-shaped member 61 and bears against the top surface of the outer flanged portion 67 of the flapper to hold it in blocking engagement with the mating slot 54 at the lower end of chute 18. When the solenoid assembly L3 is energized according to the present invention, the electromagnetic force of such solenoid will bring the flapper 51 into contact with the lower face of said solenoid and lift the flange 52 out of the mating slot 54 whereby the coin acceptance chute will be unblocked and the coin will enter the machine to which the unit is applied in the direction shown by arrow 80. In the event the coin inserted in slot 16 should be non-genuine or a slug, flange 52 of the flapper will block acceptance of the coin and such coin will be directed to the rejection chute 84 in the direction shown by the dotted arrow 85.

Figure 5:
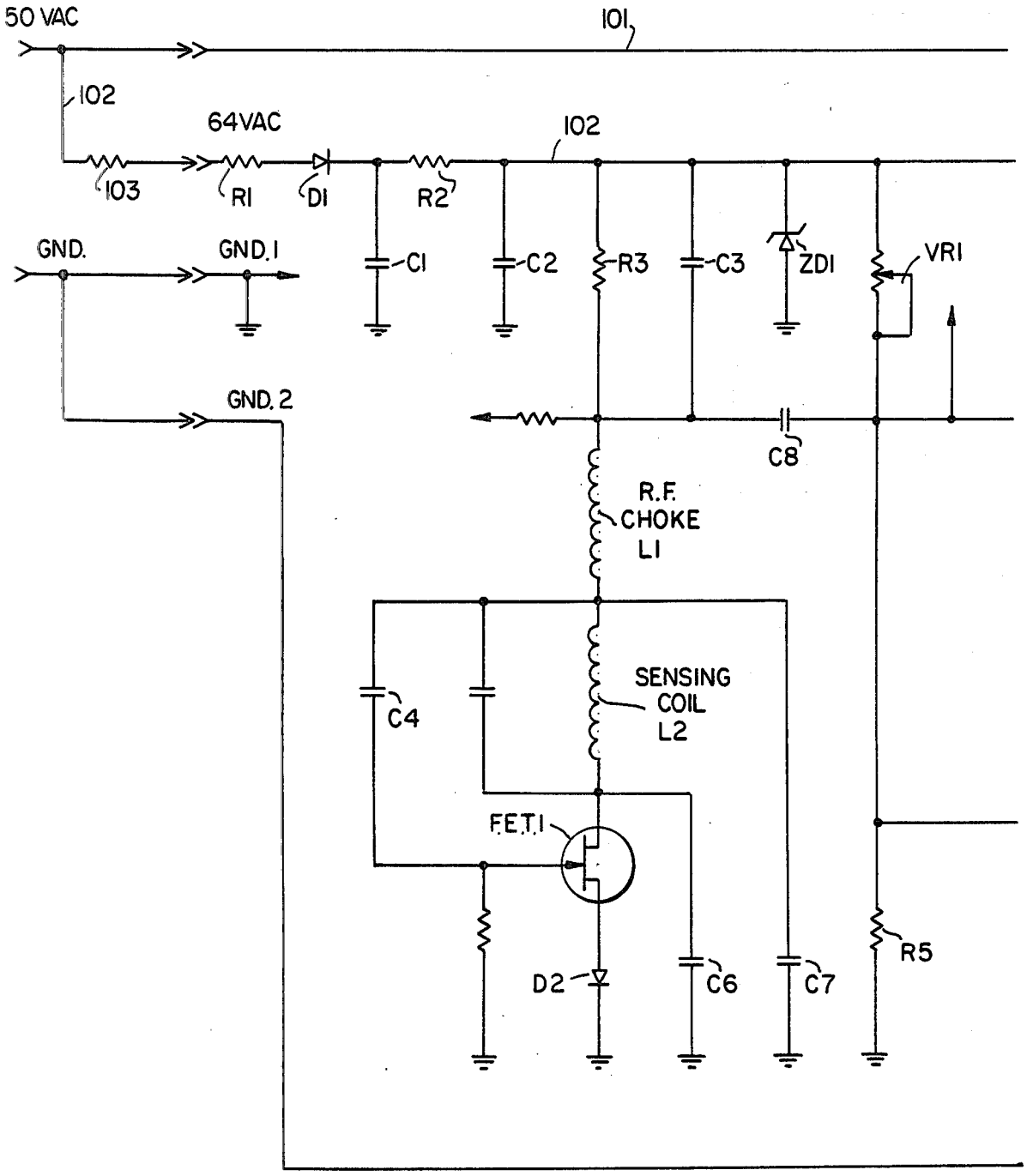
FIG. 5 shows one-half of the circuit diagram for the coin acceptor or rejector of the present invention.
Figure 6:
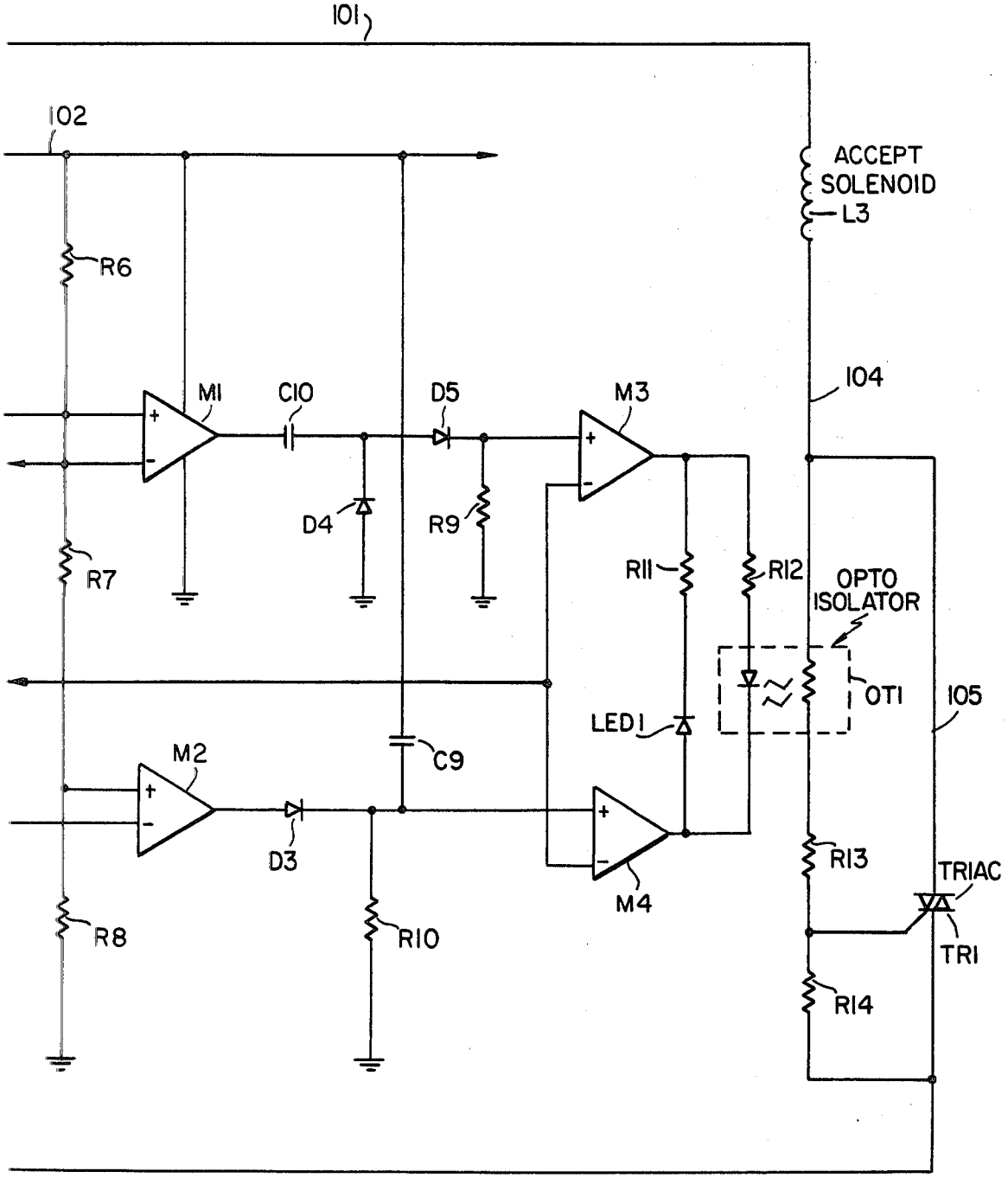
FIG. 6 shows the other half of such circuit diagram.

For a better understanding of the circuitry of the present invention reference will now be made to the accompanying circuit diagram as shown in FIGS. 5 and 6, which should be read together, as one-half of the circuit is shown on FIG. 5 and the other half is shown on FIG. 6.

The principal components of the present invention comprise:

(a) a sensing coil L2, also known as the tank coil, which surrounds the coin slot at its upper end;

(b) an oscillator circuit which includes a field effect transistor F.E.T.1 and capacitors C4, C6 and C7, the F.E.T.1 switching on and off to provide the desired oscillations and together with capacitors C4, C6 and C7 providing the necessary phase shift and feedback to sustain oscillation;

(c) a resistor R3 connected in series with the field effect transistor F.E.T.1 so that the voltage drop is directly proportional to the current which flows through the field effect transistor F.E.T.1;

(d) a pair of comparator gates M1, M2 which receive changes of voltage from F.E.T.1 and R3;

(e) a second pair of comparator gates M3, M4, which in turn are connected to an opto isolator OI1 which is activated only if the output of gate M3 is high, while the output of gate M4 remains low; and (f) an accept solenoid L3 activated when the opto isolator OI1 is activated.

It will be understood that when the accept solenoid is activated the flapper is raised by the electromagnetic effect of the solenoid to move the flapper upwardly to permit the coin to be accepted.

A more detailed description of the circuitry will now be given so as to particularly identify the parts and components shown in FIGS. 5 and 6 and their functions and purposes.

In the upper lefthand corner of FIG. 5 a source of alternating current is shown as 50 volts which has a continuous lead 101 to the accept solenoid L3. The source also has a branch 102 comprising a resistor 103 which, in turn, supplies an alternating current of 6 volts to resistor R1, diode D1 and capacitor C1, which together comprise a conventional half wave rectifier enabling the unit to be powered by 6 volts AC or DC. The resulting DC voltage appearing across capacitor C1 is connected by a limiting resistor R2 and a 6 volt Zener diode ZD1 which serves to clamp the output of capacitor C1 at a constant 6 volts. Capacitor C2, which is of low value such as one microfarad, is connected between branch 102 and ground and serves to decouple any R.F. noise. A positive voltage is applied to the drain of the field effect transistor F.E.T.1 by resistor R3, RF choke L1 and sensing coil L2. Capacitors C6, C7 and C4 provide the necessary phase shift and feedback, respectively, to sustain oscillation. The source of the field effect transistor is returned to ground via diode D2 which is provided to compensate for the temperature characteristics of the field effect transistor F.E.T.1.

As before stated resistor R3 is connected in series with the field effect transistor F.E.T.1 so that there is a voltage drop across it, such voltage drop being directly proportional to the current which flows through the field effect transistor. Capacitor C3 is connected across resistor R3 to decouple any RF noise at this point.

The voltage appearing at the junction of resistor R3, capacitor C3 and RF choke L1, is coupled by a capacitor C8 to a pair of comparator gates M1 and M2. Capacitor C8 serves to isolate the quiescent voltage appearing across resistor R3 and pass only changes in voltage to the comparator gates M1 and M2.

A resistor divided network comprising resistors R6, R7 and R8 provides a fixed reference voltage to one input of the comparator gates M1 and M2, while the resistor divided network comprising variable resistance VR1 and resistor R5, provides an adjustable threshold voltage to the other input of the same comparator gates. It is characteristic of these comparator gates that whenever the plus input of the gate is more positive than the minus input the output will be high. Conversely, whenever the minus input is more positive than the plus input then the output will be low. The reference and threshold voltages are arranged in such a manner that, under no signal conditions the output of comparator M1 will be normally high while the output of comparator M2 will be normally low.

The output of comparator M1 is connected by capacitor C10 and diode D5 to the plus input of another comparator gate M3, these components together with diode D4 and resistor R9 forming a trailing edge detector. To summarize this circuit, the output state of comparator M3, normally low, will be unaffected by any high to low transitions of comparator M1. However, the output of comparator M3 will be momentarily rendered high when the output of comparator M1 returns to its high state. The length of time that the output of comparator M3 will stay in its high state is determined by the time constant of capacitor C10 and resistor R9.

The output of comparator M2 is connected to the plus input of comparator M4 via diode D3 to form a leading edge detector. To summarize this circuit, the output of comparator M4, which is normally low, will be immediately rendered high by any low to high transition of the output of comparator M2. The output of comparator M4, in turn, will remain high for a time period determined by the time constant of capacitor C9 and resistor R10 after the output of comparator M2 has returned to its low state.

The opto isolator OI1 is connected to the outputs of comparator M3 and comparator M4 in such a way that it can only be activated if the output of comparator M3 goes high while the output of comparator M4 remains low. Leading edge detector LED1 is connected in a back-to-back configuration across the opto isolator OI1 and has two functions: (1) it shunts any reverse voltage which otherwise would appear across the opto isolator OI1; and (2) it provides a visual aid for adjusting the unit of the present invention to accept or reject any particular coin. Resistors R11 and R12 limit the current to each leading edge detector to a safe value.

The photo cell section of opto isolator OI1 is connected to form a voltage divider with accept solenoid L3, resistor R13 and resistor R14, and is so designed as to provide sufficient gate current to trigger the triac TR1 whenever the opto isolator OI1 is activated. The main terminals of the triac TR1 are connected in series with the high voltage AC supply and the accept solenoid coil L3 through leads 101, 104 and 105, thereby activating the accept armature of accept solenoid L3 whenever the opto isolator OI1 is activated.

Grounds for the unit are shown generally in the upper lefthand corner of FIG. 5 and are marked, respectively, GND, GND1 and GND2, just to illustrate in diagrammatic form the grounding of the unit to the machine in which it is inserted or fitted.

CIRCUIT OPERATION FOR ACCEPTANCE OF GENUINE COINS

When a genuine coin is passed through the sensing coil L2 the effective resistance of the field effect transistor F.E.T.1 is lowered as previously described. The increased current which then flows through the field effect transistor F.E.T.1 must also flow through resistor R3 to which it is connected in series. Because of the effective resistance drop of the field effect transistor F.E.T.1 the potential at the junction of resistor R3, RF choke L1, capacitor C3 and capacitor C8 is pulled closer to ground. This negative going change, approximating 100 millivolts for a genuine U.S. quarter is coupled by capacitor C8 to the plus input of comparator M1 and the minus input of comparator M2. Variable resistor VR1 is adjusted to hold these two inputs at a potential of 100 millivolts more positive than their complementary inputs. Because the reference level set by resistor R6, resistor R7, and resistor R8 is of a lower potential for comparator M2 than it is for comparator M1, a greater electrical signal will be required to trigger comparator M2. It will thus be understood that the 100 millivolt negative going signal produced by a U.S. quarter is sufficient to trigger comparator M1, but is insufficient to trigger comparator M2.

When the output of comparator M1 goes high due to the coin passing through the sensing coil L2, initially the output of comparator M3 remains unchanged. As the coin exits from the sensing coil L2 and comparator M1 returns to its normally high condition, comparator M3 will be turned on for the duration of the time that it takes the accumulated charge on capacitor C10 to pass through resistor R9. This time period is in the order of 120 milliseconds and under the aforementioned conditions this is the time period for which the opto isolator OI1 will be activated. The opto isolator will in turn gate the triac TR1, thereby energizing the accept solenoid L3 for the same period of time. The 120 milliseconds time period is required in order to allow the coin sufficient time to pass by the accept gas or flange 52 without getting trapped in the chute 18.

CIRCUIT OPERATION FOR REJECTION OF NON-GENUINE COINS

Non-genuine coins such as those chiefly composed of copper, brass, aluminum, and lead when passed through the sensing coil L2 do not lower the effective resistance of the field effect transistor F.E.T.1 sufficiently to produce the required 100 millivolt signal. Therefore the outputs of comparators M1 and M2 are completely unaffected and these coins are rejected by the unit. When a coin of ferrous nature such as steel slugs is used, a signal much greater than the 100 millivolts is produced. In this instance the output of comparator M1 will go low as the signal passes the 100 millivolt level. As previously explained, the output of comparator M3 will be unaffected by this transition. Also, because the signal is substantially higher than 100 millivolts, the output of comparator M2 will be forced from its low state to its high state. As soon as the output of comparator M2 goes high, the output of comparator M4 will also go high and remain in that condition for a longer period of time, such as 200 milliseconds, than does comparator M3 as a result of the trailing edge. Under these conditions the opto isolator OI1 cannot be activated as both sides of it are held at the same potential. After the passages of such ferrous slug through the sensing coil L2, comparator M3 will return to its low state approximately 80 milliseconds before comparator M4 returns to its normally low state. During this 80 millisecond period when comparator M3 is low and comparator M4 is high, the adjustment indicator LED1 will be turned on. The visual indication given by this indicator provides information as to the way in which to adjust the sensitivity control of variable resistance VR1 for any given coin.

As before stated, when the opto isolator OI1 is not actuated by non-genuine coins such as those chiefly composed of copper, brass, aluminum and lead because the effective resistance of the field effect transistor F.E.T.1 is insufficient to produce the required 100 millivolt signal; or when the non-genuine coin is of a ferrous nature which produces a signal much greater than the 100 millivolts, the triac TR1 will not be actuated and, in turn, the accept solenoid L3 will not be actuated. Hence, as best seen in FIG. 4, the flanged end 52 of flapper 51 will not unblock chute 18 and will reject such coin by directing it to the reject opening 84 along the line of dotted arrow 85.

What I claim is:

1. A coin acceptor or rejector apparatus for use in coin-operated machines and the like, comprising a coin chute having a slot for receiving a coin, said chute having a coin acceptance portion and a coin rejection portion, a flapper controlling the direction of movement of coins to one or the other of said portions, an oscillator circuit adapted to oscillate at a substantially constant amplitude, a sensing coil surrounding the chute at its upper end adjacent said slot and actuated by a coin passing therethrough, said sensing coil upon receipt of a coin having its Q substantially decreased and having energy losses caused by eddy currents being dissipated by the coin and by the magnetic hysteresis of the coin whereby the effective resistance of the oscillator circuit is reduced and the current flow therethrough is increased, comparative circuitry for discriminating the change in current and resulting voltage within predetermined limits, and a solenoid energized by the change in resulting voltage within the limit prescribed for a genuine coin which moves the flapper to coin acceptance position.

2. A coin acceptor or rejector apparatus according to claim 1, wherein the resulting voltages of said comparative circuitry for non-genuine coins or lugs are outside the prescribed limits for genuine coins, the solenoid is not energized, and the coin is directed to the rejection portion of the chute.

3. A coin acceptor or rejector apparatus according to claim 1, wherein the oscillator circuit includes a field effect transistor and a resistor in series therewith.

4. A coin acceptor or rejector apparatus according to claim 1, wherein the oscillator circuit includes a field effect transistor, a resistor, an RF choke, and a diode in series therewith, said diode compensating for temperature characteristics of the field effect resistor.

5. A coin acceptor or rejector apparatus according to claim 1, wherein the oscillator circuit includes a field effect transistor, an RF choke, and a resistor in series therewith, and a capacitor in parallel with said resistor, all of which have a junction point in series with another capacitor which, in turn, provides a predetermined voltage of approximately 100 millivolts when coupled with the plus terminal of one comparator and the minus terminal of a second comparator of the comparator circuit when a genuine coin is inserted in the coin receiving slot.

6. A coin acceptor or rejector apparatus according to claim 1, wherein the oscillator circuit includes a field effect transistor, an RF choke and a resistor in series therewith, and a capacitor in parallel with said resistor, all of which have a junction point in series with another capacitor which, in turn, provides a predetermined voltage of approximately 100 millivolts when coupled with the plus terminal of one comparator and the minus terminal of a second comparator of the comparator circuit when a genuine coin is inserted in the coin receiving slot, and also having a variable resistor for holding the potential at the predetermined voltage of approximately 100 millivolts.

7. A coin acceptor or rejector apparatus according to claim 1, wherein the comparative circuitry for discriminating the change in current and resulting voltage within predetermined limits comprises two pairs of comparators, wherein the change in current and the resulting voltage within the predetermined limits will trigger the first capacitor of the first pair but will not trigger the second comparator of the first pair, so that the output of the first comparator goes high due to the coin passing through the sensing coil.

8. A coin acceptor or rejector apparatus according to claim 7, wherein a trailing edge detector is disposed between the comparator of the first pair and the comparator of the second pair.

9. A coin acceptor or rejector apparatus according to claim 7, wherein a trailing edge detector is disposed between the comparator of the first pair and the comparator of the second pair, said trailing edge detector comprising a capacitor, two diodes, and a resistor whereby the comparator of the second pair will be turned on for the duration of the time that it takes the accumulated charge on the capacitor of the trailing edge detector to pass through the resistor of such trailing edge detector.

10. A coin acceptor or rejector apparatus according to claim 9, wherein the time for the accumulated charge on the capacitor of the trailing edge detector to pass through the resistor is approximately 120 milliseconds.

11. A coin acceptor or rejector apparatus according to claim 7 wherein an opto isolator is activated by the first comparator of the second pair of comparators which, in turn, gates a triac and thereupon energizes the solenoid for acceptance of genuine coins.

12. A coin acceptor or rejector apparatus according to claim 9, wherein the time for the accumulated charge on the capacitor of the trailing edge detector to pass through the resistor is approximately 120 milliseconds, and having an opto isolator which is activated by the first comparator of the second pair of comparators, and, in turn, gates a triac and energizes the solenoid for approximately the same period of 120 milliseconds to allow genuine coins to pass into the acceptance chute.

13. A coin acceptor or rejector apparatus according to claim 1, wherein non-ferrous spurious coins or slugs when passed through the sensing coil do not increase the change in current and resulting voltage within such predetermined limits, and the solenoid is not energized to move the flapper and such coins are diverted to the rejection chute.

14. A coin acceptor or rejector apparatus according to claim 1, wherein the oscillator circuit includes a field effect transistor, an RF choke and a resistor in series therewith, and a capacitor in parallel with said resistor, all of which have a junction point in series with another capacitor which, in turn, provides a predetermined voltage of approximately 100 millivolts when coupled with the plus terminal of one comparator and the minus terminal of a second comparator of the comparator circuit when a genuine coin is inserted in the coin receiving slot, and wherein the field effect transistor does not produce the required approximate 100 millivolt signal when a non-genuine, non-ferrous coin is inserted in the coin slot.

15. A coin acceptor or rejector apparatus according to claim 1, wherein the oscillator circuit includes a field effect transistor, an RF choke and a resistor in series therewith, and a capacitor in parallel with said resistor, all of which have a junction point in series with another capacitor which, in turn, provides a predetermined voltage of approximately 100 millivolts when coupled with the plus terminal of one comparator and the minus terminal of a second comparator of the comparator circuit when a genuine coin is inserted in the coin receiving slot, and wherein the field effect transistor produces a signal higher than 100 millivolts when a ferrous coin or slug is inserted in the coin slot.

16. A coin acceptor or rejector apparatus according to claim 15, wherein a second pair of comparators is provided, and wherein the first comparator of the second pair is unaffected when the output of the first comparator of the first pair goes low as the signal passes approximately the 100 millivolt level, and wherein the output of the second comparator of the second pair of comparators remains in that condition for a longer period of time than does the first comparator of the second pair whereby both sides of an opto isolator are held at the same potential and such opto isolator, in turn, does not actuate a triac and, in turn, the accept solenoid.

17. A coin acceptor or rejector apparatus according to claim 1, wherein the flapper has a flange at its lower end, the coin chute has a slot for receiving the flanged end of such flapper, a leaf spring normally holds the flapper in said slot to direct non-genuine coins to a rejection position, and said solenoid when energized raises the flapper and the flange to permit the coin to be accepted.

* * * * *